US005205364A

United States Patent [19]

Juergens et al.

[11] Patent Number: 5,205,364

[45] Date of Patent: Apr. 27, 1993

[54] PROCESS AND DRILLING EQUIPMENT FOR SINKING A WELL IN UNDERGROUND ROCK FORMATIONS

[75] Inventors: Rainer Juergens, Celle; Friedhelm Makohl, Hermannsberg, both of Fed. Rep. of Germany

[73] Assignee: Baker Hughes Incorporated, Delaware, N.J.

[21] Appl. No.: 737,771

[22] Filed: Jul. 30, 1991

[30] Foreign Application Priority Data

Jul. 30, 1990 [DE] Fed. Rep. of Germany ..... 4024107

[51] Int. Cl.[5] ..... E21B 21/08

[52] U.S. Cl. ..... 175/38; 175/65; 175/321

[58] Field of Search ..... 175/61, 321, 65, 38; 267/125

[56] References Cited

U.S. PATENT DOCUMENTS

| | | | |
|---|---|---|---|
| 3,814,183 | 6/1974 | Kishel | 175/321 |
| 3,997,008 | 12/1976 | Kellner | 175/61 |
| 4,261,427 | 4/1981 | Sutliff et al. | 175/297 |
| 4,434,863 | 3/1984 | Garrett | 175/321 |
| 4,440,241 | 4/1984 | Anders . | |
| 4,552,230 | 11/1985 | Anderson et al. | 175/321 |
| 4,763,734 | 8/1988 | Dickenson et al. | 175/61 |

*Primary Examiner*—Ramon S. Britts
*Assistant Examiner*—Frank S. Tsay
*Attorney, Agent, or Firm*—Joseph A. Walkowski

[57] ABSTRACT

The present invention is a drilling tool including a telescoping assembly for transmitting hydraulic force to the drill bit at the bottom of the tool. The internal hydraulic characteristics of the tool may be varied to vary the force through extension and retraction of the telescoping assembly.

25 Claims, 4 Drawing Sheets

PROCESS AND DRILLING EQUIPMENT FOR SINKING A WELL IN UNDERGROUND ROCK FORMATIONS

BACKGROUND OF THE INVENTION

1. Field of the Invention

This invention concerns a process and equipment for sinking a well in underground rock formations.

2. State of the Art

Sinking wells with a drilling tool that has limited axial mobility relative to the drill casing by means of a telescopic connection is accomplished with known processes and drilling equipment to accomplish various goals. A main goal is the possibility of longitudinal adjustments (German Utility Patent 88 16 167) which are desirable and necessary, especially when sinking wells from floating drilling platforms. In another case (U.S. Pat. No. 4,440,241), the purpose of the longitudinal variability is to adjust the distance between a first o stabilizer located close to the rotary drill bit and a second stabilizer above the first in order to influence the bending behavior of the drilling tool and thus control the angle of adjustment of the middle axis of the drill bit relative to the axis of the borehole and in this way influence the direction of drilling. Finally, with shock reducers, a telescopic connection serves to provide a tolerance in movement for impacts.

SUMMARY OF THE INVENTION

This invention is based on the problem of creating a process that will permit an increase in drilling rate under variable drilling parameters such as rock hardness.

The process according to this invention with its adjustment of the drilling force which is controlled aboveground by varying the hydraulic parameters that define the transfer of hydraulic force to the rotary drill bit assures optimization of the drilling rate with regard to the prevailing rock hardness, the direction of drilling, the design and rotary speed of the drill bit and other drilling parameters that determine the course of drilling. In this process, the load on the drill bit is equalized by excluding feedback effects of the drill casing which constantly generates axial vibrations due to its torsion spring effect resulting from the mechanical axial uncoupling of the drill bit.

This invention is also based on the problem of creating a structurally simple drilling system whereby the rotary drill bit of the drilling tool operates so it is largely free of interfering influences inherent in the system under improved conditions for the drilling process.

The drilling tool of the invention makes it possible to influence the drill bit in a manner that is largely free of internal interfering influences with a drilling force that is adapted to the conditions prevailing in the formation, and this is accomplished by means of a simple design and reliable operation. Since the part of the drilling apparatus located beneath the telescopic assembly is coupled axially only by hydraulic means to the part above it, all components above the telescopic assembly are subjected only to tensile stress with the result being an increased lifetime of the drilling equipment whose threads are thereby relieved of load. Then the drill stems have the primary function of preventing buckling, so this simplifies the drilling equipment. Moreover, an extremely precise aboveground determination of the drilling pressure which is applied hydraulically is made possible in this way because the reaction force for the drilling pressure which is compensated by the weight of the drill casing can be determined easily and with a high degree of accuracy from the drilling rig hook load.

BRIEF DESCRIPTION OF THE DRAWINGS

Additional details and advantages are derived from the following description of the process as well as the drilling equipment on the basis of the figures which illustrate several practical examples of the object according to this invention, namely.

DESCRIPTION OF THE PREFERRED EMBODIMENTS

Figure 1:
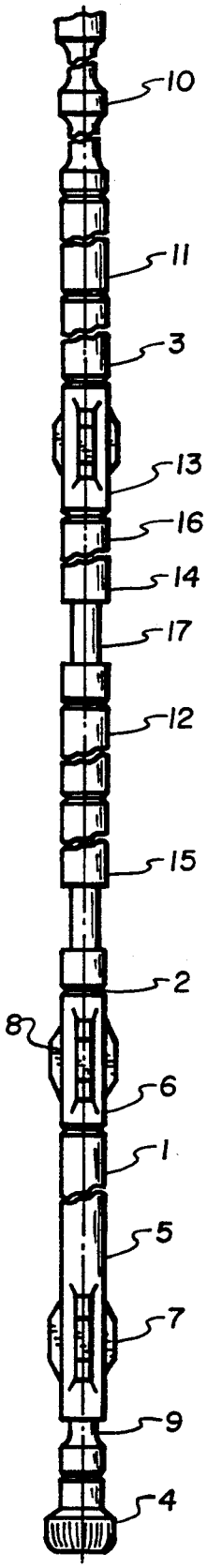
FIG. 1 shows a cutaway overall side view of a drilling apparatus according to this invention.

The drilling equipment illustrated in FIG. 1 includes a drilling tool 1 that is connected to a drill casing 3 by connecting means in the form of a connecting thread 2 and is provided with a rotary drill bit 4 on the end facing away from the drill casing 3. The tubular outer casing 5,6 of the drilling tool 1 is provided with a stabilizer formed by stabilizer ribs or vanes 7,8 in its lower area and in its upper area. Rotary drill bit 4 can be connected directly in a manner that prevents torsion transmission to the outer casing 5,6 of drilling tool 1 and it can receive its rotary drive from drill casing 3. However, a deep drilling motor of any known or suitable design is preferably provided in outer casing 5,6, e.g., a Moineau motor driven by drilling mud or a turbine operated by drilling mud with whose shaft 9 rotary drill bit 4 is connected. Outer casing 5,6 of the drilling tool can be aligned with its central longitudinal axis coaxial with the axis of rotation of parts 4,9 as shown in the figure, but there is also the possibility of designing the drilling tool as a directional drilling tool, especially as a navigational drilling tool, whereby a slight curve in the course relative to the axis of the borehole is imparted to the axis of rotation for parts 4,9 by having shaft 9 positioned at an incline in outer casing part 5 and/or by means of bends in the area of outer casing parts 5,6.

Drill casing 3 that is shown here only with its lower end comprises in the example shown here a heavy drill collar 10, several of which can be arranged one above the other, sinker bars 11,12, stabilizer 13 and in the example illustrated in FIG. 1 two telescopic assemblies 14,15 that may be either structurally different or the same. In all the versions described below, these telescopic assemblies will always have an outer tubular part 16, an inner tubular part 17 that is guided axially so it moves in parallel in the former and connecting means in the form of connecting threads 18,19 for installation in the lower area of drilling casing 3. Instead of such an installation in the lower area of drill casing 3 and directly above drilling tool 1, an individual telescopic assembly may also be provided between drilling tool 1 and drill casing 3 or between the upper and lower parts 6 and 5 of the outer casing of drilling tool 1.

Figure 2:
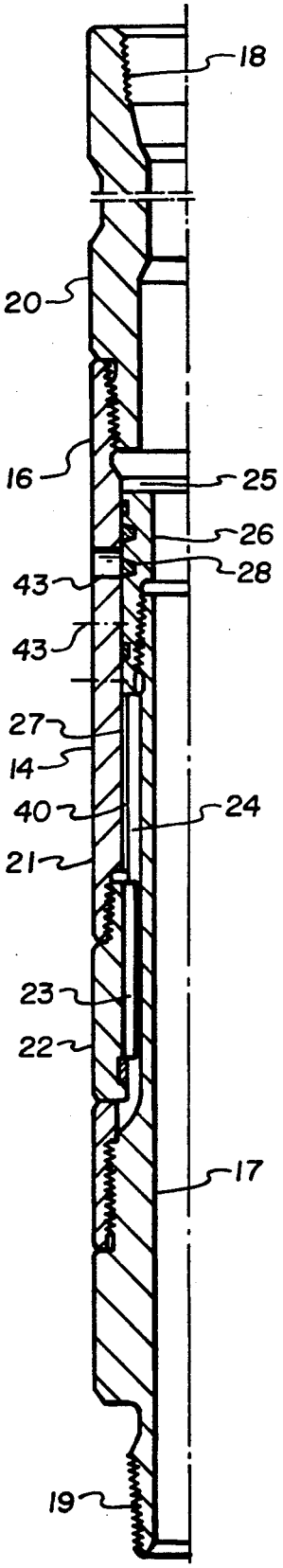
FIG. 2 shows an axial half section through a first version of a telescopic assembly according to this invention which is provided with elements for varying the axial force applied by the drilling mud.

As shown in FIG. 2 with a first version of a telescopic assembly 14 (or 15), devices for the rotational coupling of the two tubular parts 16,17 are provided between the outer tubular part 16 which is formed from tube sections 20,21,22 that are screwed together and inner tubular part 17. In the example shown here, these devices for rotational coupling consist of an axial tongue-and-groove joint. The tongues 23, several of which may be distributed evenly around the circumference, are secured in the outer tubular part 16 in the example according to FIG. 2, whereas the grooves 24 are provided on the inner tubular part 17. The outer tubular part 16 then forms the part on the casing end and the inner tubular part 17 forms a part on the drill bit end.

Tubular part 17 on the drill bit end is illustrated in FIG. 2 in its fully inserted position within tubular part 16 on the casing end. In the version according to FIG. 2, tubular part 17 has a pressure face 25 which is acted on axially by drilling mud conveyed downward through drill casing 3 and drilling tool 1 in order to transmit the resulting drill bit pressure. This pressure face 25 is formed by the piston face of a ring piston part 26 facing the oncoming drilling mud in the version according to FIG. 2. On the circumference the ring piston part is sealed by means of gaskets 28 with respect to a cylinder wall area 27 of tubular part 16 on the casing end. The outside diameter of the ring piston part 26 accordingly defines the effective hydraulic area.

Ring piston part 26 is preferably a separate component that is detachably connected to tubular part 17 on the drill bit end and forms a device for varying the hydraulic parameters that define the hydraulic force acting on tubular part 17 on the drill bit end and for this purpose it can be replaced by a component with a different outside diameter, together with tube section 21 that defines the cylindrical wall area 27 of tubular part 16 on the casing side, where this tube section is easily replaced due to the fact that it is screwed to tube sections 20,22. Instead of changing parts as a means of changing the drilling pressure or in addition to this option, the drilling pressure can also be varied by changing the volume flow in the drilling mud which is controlled from aboveground. This can be accomplished easily and simply with the help of the delivery pump for the drilling mud and as a function of the hook load of the drill casing.

Instead of a single pressure face, tubular part 17 on the drill bit end may also include several pressure faces 29,30 arranged with axial spacing between them so that each derives an axial force from the oncoming drilling mud and these axial force components are additive in forming the resulting drilling pressure.

Figure 3:
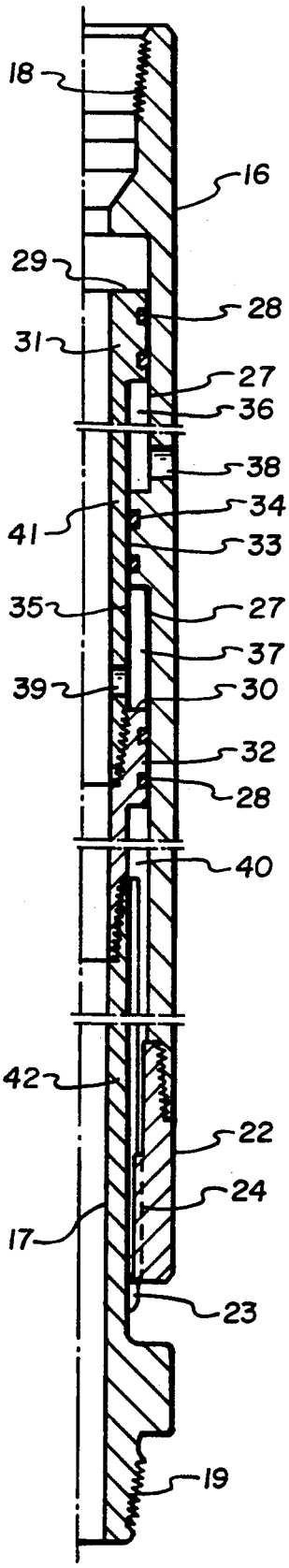
FIG. 3 shows a diagram like FIG. 2 of a second version of a telescopic apparatus according to this invention with multiple arrangements of pressure applying elements.

Such a version is illustrated in FIG. 3 where the same parts are labeled with the same reference numbers as in the version according to FIG. 2. The pressure faces 29,30 are designed on piston parts 31,32 arranged with an axial spacing between them and these piston parts are in turn sealed by means of gaskets 28 with respect to cylinder wall areas 27 in tubular part 16 on the casing end. The two cylinder wall areas 27 are separated from each other by a ring shoulder 33 that projects inward and forms a seal by means of gaskets 34 with a cylinder wall area 35 on the outside of tubular part 17 on the drill bit end. Accordingly, an annular space 36 and 37 extends between ring shoulder 33 and piston parts 31,32 and between cylinder wall areas 27,35. Of these annular spaces, annular space 36 communicates with the annular space of the borehole by way of a pressure relief bore 38. Annular space 37, however, is connected by a connecting bore 39 to the central drilling mud channel which is bordered by parts 16,17 in the interior of telescopic assembly 14,15. In this way, the same pressure acts on pressure face 30, namely the drilling mud pressure, as the pressure acting on pressure face 29, so the axially downward directed forces derived from the pressures in the drilling mud are additive. An annular space 40, which like annular space 40 in FIG. 2 communicates with the annular space of the borehole at the lower end of the outer tubular part 16, is provided on the side of piston part 32 that faces away from annular space 37.

The inner tubular part 17 in the example shown here consists of two sections 41,42 that are screwed together for assembly reasons where the screw connection is accomplished by means of piston part 32 as a separate intermediate piece. In a modification of the version according to FIG. 2, the tongues 23 in the version according to FIG. 3 are assigned to section 42 of tubular part 17 on the drill bit end, whereas section 22 of tubular part 16 on the casing end is provided with the grooves of the rotational coupling. The upper section of tubular part 16 on the casing end is illustrated in FIG. 3 without any further subdivision, but it is self-evident that the subdivision shown in FIG. 2 can also be provided accordingly with a double piston arrangement according to FIG. 3. In an especially preferred version of this invention, the devices for varying the hydraulic parameters can be activated by varying the extended length of the telescopic assembly 14 or 15. This permits an especially simple and rapid adjustment of the drilling force to changes in drilling parameters simply as a function of the extended length of the telescopic device 14 and 15 which can easily be controlled aboveground and permits a continuous variation in drilling pressure, like the variation in pressure in the drilling mud, by varying the parameters for the hydraulic pressure action without any interruption in operation. The change in drilling force with no change in pressure in the drilling mud has the advantage that the pressure of the drilling mud can be selected exclusively according to technical aspects that pertain to the drilling mud such as drill bit cooling and cleaning and transport of drilling fines.

A first possibility for varying the hydraulic parameters as a function of the extended length of the telescopic assembly 14,15 is indicated in FIG. 2 and is formed by bypass channels 43 in the form of radial bores in the wall of tubular part 16 on the casing end whose inlet openings are covered by the ring piston part 26 when the tubular part 17 on the drill bit end is in the fully inserted position. These bypass channels 43 can be released progressively by extension of the tubular part 17 on the drill bit end of telescopic assembly 14,15 in order to reduce the pressure in the drilling mud acting on the faces 25 of ring piston part 26.

Instead of radial bores arranged axially above each other as bypass channels 43, a bypass slit extending axially can also be provided where this bypass slit has a uniform width or the width may increase in the direction of drill bit 4.

Figure 4:
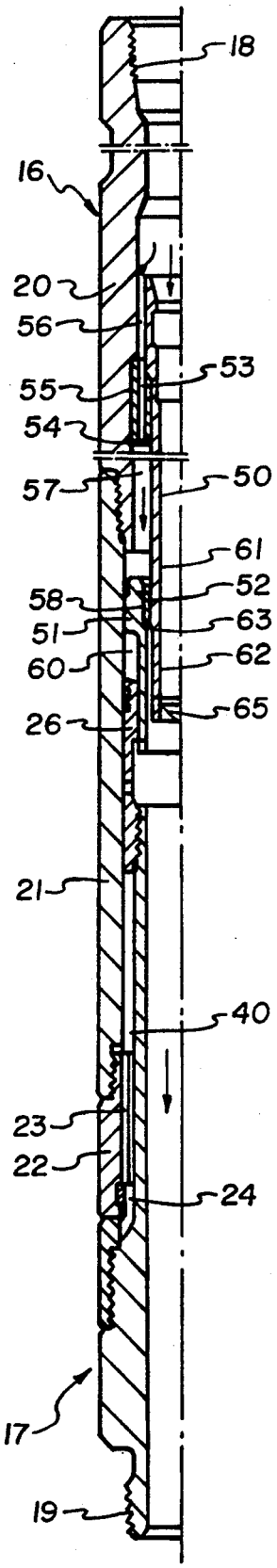
FIGS. 4 to 6 show,, diagrams of a third version according to this invention in different positions.
Figure 5:
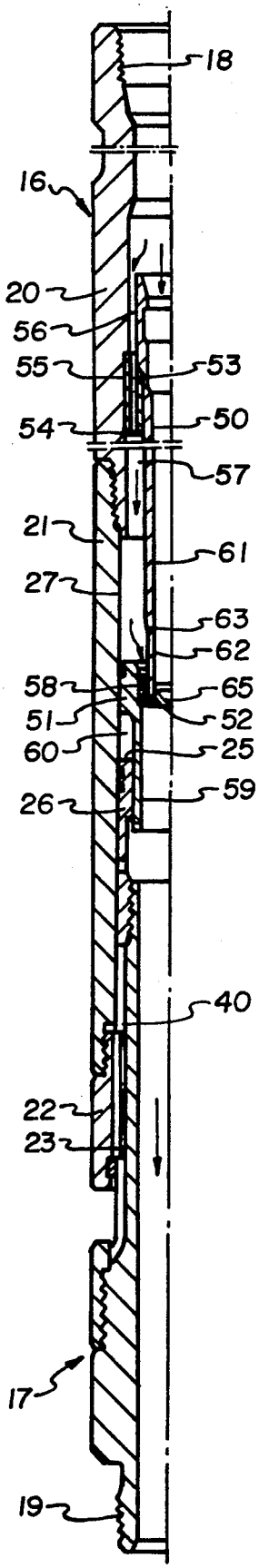
Figure 6:
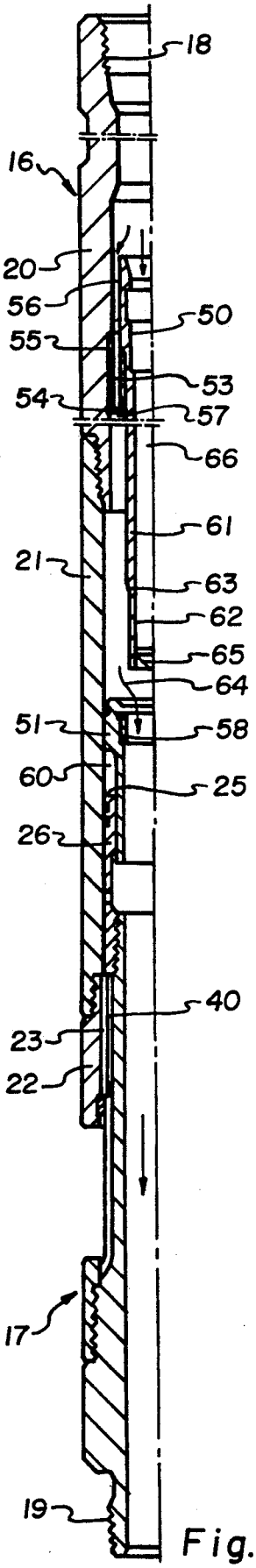

Another possibility of varying the hydraulic parameters as a function of extension is illustrated by an especially advantageous version as shown in FIGS. 4 to 6. In this version, which is similar in basic design to that according to FIG. 2, a tubular nozzle body 50 is provided for the tubular part 16 on the casing end, and when the tubular part 17 on the drill bit end is inserted into its end position inside of tubular part 16 on the casing end, the tubular nozzle body 50 engages with the tubular part 17 on the drill bit end. Tubular nozzle body 50 defines an axially extending annular gap 52 for the passage of drilling mud either directly with piston part 26 of tubular part 17 on the drill bit end or with a nozzle ring part 51 assigned to it, where the cross section of flow of the drilling mud is increased or decreased in stages as in the example shown here with an increase in the extracted or extended length of the telescopic assembly 14,15.

Tubular nozzle body 50 is supported by a bushing 55 that is provided with axial boreholes 53 and whose position is secured by means of a securing ring 54 in tubular part 16 on the casing end, and it defines with its outside an annular space 56 on the inside above bushing 55 and a corresponding annular space 57 below this bushing 55 through which drilling mud flows, coming out of annular gap 57 through annular gap 52.

Nozzle ring part 51 is provided on the inside with a wear ring 58 that forms the outer border of the annular gap 52 and comprises an apron 59 that extends downward and forms a seal together with the inside of piston part 26. At the same time, nozzle ring part 51 forms a seal in the area of its upper main part with the cylinder wall area 27 of tubular part 17 on the drill bit end and as a result of this seal the nozzle ring part 51, piston part 26 and cylinder wall area 27 together define a ring chamber 60 that is filled with an incompressible lubricant for lubrication of the sliding path. The incompressible lubricant acts like a rigid axial force transmitting element with the result that the nozzle ring part 51 follows axial movements of piston part 26 simultaneously and uniformly in accordance with axial movements of tubular part 17 on the drill bit end.

The only function of nozzle ring part 51 is to form an annular chamber 60 for lubricant which adjusts in volume to the progressive consumption of lubricant. Nozzle ring part 51 can be omitted if lubrication is unnecessary. Instead of annular chamber 60 which is defined by nozzle ring part 51 for lubricant above piston part 26, such an annular chamber may also be provided below piston part 26, and in this case it is bordered by means of a sealing ring that is acted on by drilling mud on its lower side. In such a case, the inside of piston part 26 or a wear ring provided on the piston part forms the direct outer border of the annular gap 52.

Tubular nozzle body 50 has a central part 61 whose outside borders the annular gap 52 on its inside when the parts are in or close to the final insertion position as in FIG. 4. Central part 61 develops into a projection 62 by way of an inclined area 63 where the projection has a reduced outside diameter which forms the inside border of annular gap 52 in a central extracted area for parts 16,17 extended relative to each other as shown in FIG. 5. The cross section of the annular gap in this extracted area is greater than that formed by the annular gap 52 in the position of the parts according to FIG. 4, i.e., with a border on the inside formed by the central part 61 of tubular nozzle body 50.

If tubular parts 16,17 are extended further yet as illustrated in FIG. 6, then the lower end of tubular nozzle body 50 will go from an overlapping position with nozzle ring part 51 into an extended position above this with the result being that a free passage 64 is formed, permitting unthrottled flow of drilling mud out of annular space 57.

A throttling element 65 that defines a narrow cross section of flow for drilling mud out of the axial internal channel 66 of tubular nozzle body is provided in the area of the lower end of tubular nozzle body 50. As a result, a pressure that is increased by the damming effect of throttling element 65 is created in the drilling mud above the upper end of tubular nozzle body 50 and then the drilling mud can also enter annular spaces 56,57 and act axially downward on piston part 26 by way of nozzle ring part 51. The pressure acting on nozzle ring part 51 is reduced due to the flow of drilling mud out of annular space 57 through annular gap 52 which is initially throttled greatly but later is throttled to a lesser extent, but a pressure difference that is increased by the throttling effect acts on piston part 26 and thus on tubular part 16 on the drill bit end and remains until tubular nozzle body 50 has been extracted out of nozzle ring part 51.

If there is an increase in the cross section of the annular gap as part of a movement of the tubular part 17 on the drill bit end relative to the tubular part 16 from the position according to FIG. 4 into a position according to FIG. 5, then the pressure in the annular space 57 above nozzle ring body 51 is reduced and this change in hydraulic parameters reduces the forces acting axially downward on tubular part 17 on the drill bit end and thus on rotary drill bit 4. In a transfer of the parts from the extracted position according to FIG. 5 into the extracted position according to FIG. 6, hydraulic parameters corresponding essentially to those according to FIG. 2 become operative. The deciding factor for the pressure difference in FIGS. 2 and 6 is the pressure in the drilling mud directly above nozzle ring part 51 and the pressure in the drilling mud in the annular space of a borehole on the outside of telescopic assembly 14,15.

Instead of the stepwise change in hydraulic parameters achieved in the version according to FIGS. 4 to 6 in accordance with the extended length of telescopic assembly 14,15, a continuous change can be achieved, e.g., by the fact that the exterior bordering face of annular gap 52 may have a conical taper toward the bottom while the inside border of the annular gap 52 is formed by a uniform cylindrical outer face of tubular nozzle body 50.

Tubular nozzle body 50 is supported by bushing 55 as a component that can be removed from the tool and replaced, so this yields another possibility for varying the hydraulic parameters for a hydraulic transfer of force by way of an exchange of the tubular nozzle body with a different design.

Figure 7:
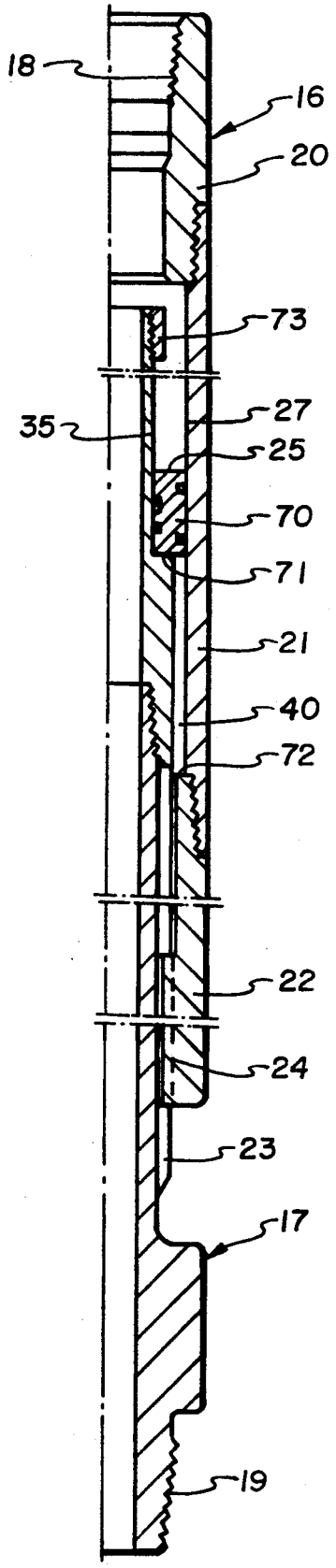
FIGS. 7 and 8 show diagrams of a fourth version according to this invention in different extended lengths.
Figure 8:
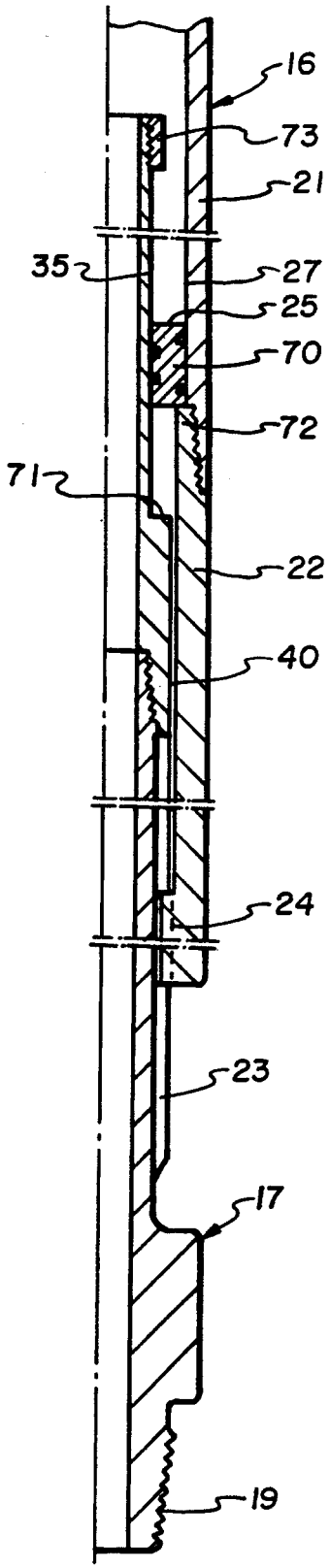

Another version of the devices for varying the hydraulic parameters that determine the hydraulic transfer of force to the tubular part 17 on the drill bit end is illustrated in FIGS. 7 and 8 where components that correspond to those in the version according to FIG. 2 are provided with the same reference numbers.

In contrast with the version according to FIG. 2, the piston part for the hydraulic transfer of axial forces to tubular part 17 on the drill bit end is a differential piston in the form of a ring piston part arranged so it forms a seal between coaxial cylindrical wall areas 27,35 of tubular parts 16,17 on the respective drill bit end and the casing end and it can be shifted to a limited extent relative to these two parts.

Cylinder wall area 35 of tubular part 17 on the drill bit end is provided with an entraining shoulder 71 for ring piston part 70 on its end near the drill bit, and cylinder wall area 27 of tubular part 16 on the casing end has a stop shoulder 72 for a ring piston part 70 which is located in a partial extraction area of tubular part 17 with respect to tubular part 16 next to the fully inserted position (FIG. 7) toward the side of rotary drill bit 4 at a distance from entraining shoulder 71 on tubular part 17 on the drill bit end.

Ring piston part 70 is under the influence of the pressure of the drilling mud on its pressure face 25 and as long as the differential piston rests on entraining shoulder 71 of tubular part 17 on the drill bit end, ring piston part 70 acts like a piston part that is permanently connected to tubular part 17 on the drill bit end whose outside diameter defines the effective hydraulic area for the hydraulic transfer of force to the tubular part 17 on the drill bit end.

If entraining shoulder 71 on the end of the first partial extraction area adjacent to the final insertion position passes by stop shoulder 72, the ring piston part 70 will stop against stop shoulder 72 with the result that the outside diameter of cylinder wall area 35 of tubular part 17 on the drill bit end defines the hydraulic face that is operative for it for the second partial extraction area.

On its end facing away from entraining shoulder 71, the cylinder wall area 35 of tubular part 17 on the drill bit end has a stop 73 that limits the second partial extraction range for tubular part 17 on the drill bit end.

Figure 9:
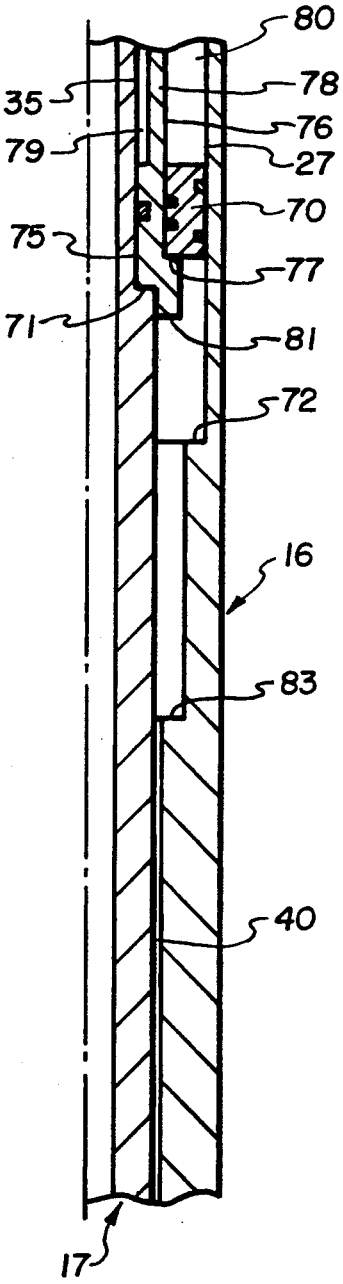
FIGS. 9 to 11 show diagrams like FIG. 2 of a fifth version according to this invention in different extended lengths as seen in a detail.
Figure 10:
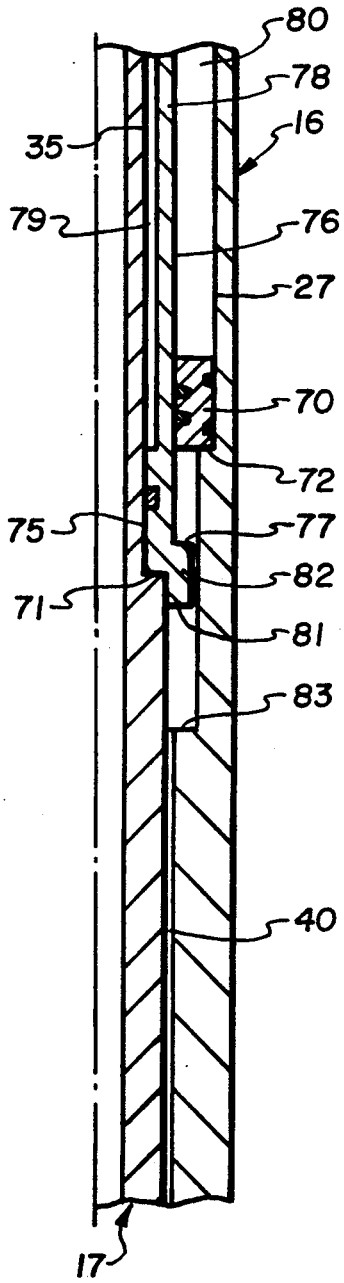
Figure 11:
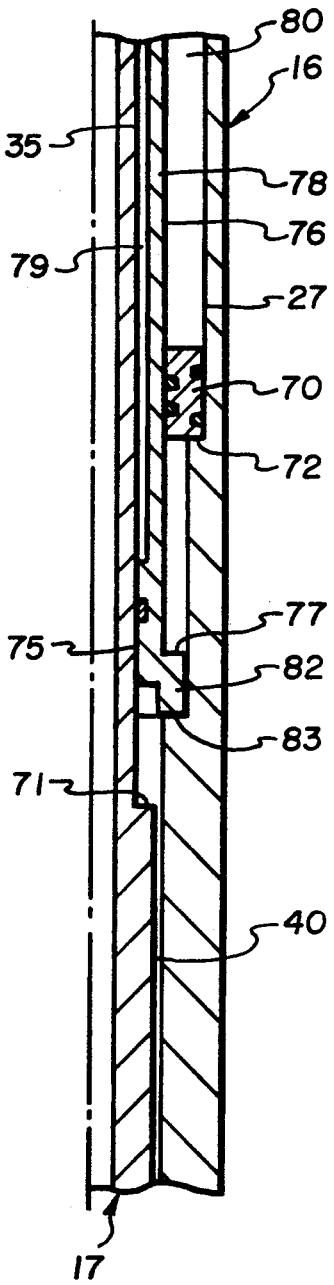

FIGS. 9 to 11 illustrate a modified version of the version illustrated in FIGS. 7 and 8 which employs a double differential piston design. Again in FIGS. 9 to 11 parts that correspond to the parts in FIGS. 7 and 8 have been provided with the same reference numbers.

In the version according to FIGS. 9 to 11, a bushing-type additional piston part 75 is provided for ring piston part 70 and can move along the cylinder wall area 35 of tubular part 17 on the drill bit end. The exterior of additional piston part 75 forms a cylinder wall area 76 for ring piston part 70 and is provided with an entraining shoulder 77 for ring piston part 70 on its end near the drill bit. The additional piston part 75 is sealed close to its lower end on the drill bit side with respect to the cylinder wall area 35 of tubular part 17 on the drill bit end, and in its upstream upper area 78 it extends around cylinder wall area 35 of tubular part 17 at a distance, thereby forming annular space 79 which is open toward the top between the upper additional piston area 78 and cylinder wall area 35. Annular space 79, like annular space 80 between the upper area 78 of the additional piston part 75 and cylinder wall area 27 of tubular part 16 on the casing end, is open toward the top and is accordingly accessible to drilling mud.

In the position of tubular parts 16,17 relative to each other close to the fully inserted position illustrated in FIG. 9, an axial hydraulic force derived from the drilling mud acts on tubular part 17 near the drill bit end where the size of this force is determined by the outside diameter of ring piston part 70 as the parameter that defines the effective hydraulic area. Ring piston part 70 rests on entraining shoulder 77 of additional piston part 75 and the latter rests on entraining shoulder 71 of tubular part 17 on the drill bit end, so the two piston parts act as if they were rigidly connected to tubular part 17.

In an extraction or extension movement of tubular part 17 relative to tubular part 16, the hydraulic parameters remain unchanged until ring piston part 70 comes to rest on stop shoulder 72 on tubular part 16 on the casing end and is lifted away from the entraining shoulder 77 with a further downward movement of additional piston part 75 as illustrated in FIG. 10. With the axial separation of ring piston part 70 and additional piston part 75, the effective hydraulic area for deriving an axial force on tubular part 17 on the drill bit end is reduced to a size that is defined by the outside diameter of cylinder wall area 76 of additional piston part 75.

When the tubular part 17 on the drill bit end is extracted or extended further relative to tubular part 16 on the casing end beyond the position of the parts illustrated in FIG. 10, the additional piston part 75 with end face 81 engages a lower shoulder 82 with another stop shoulder 83 on tubular part 16 on the casing end, and with a further extraction or downward movement of tubular part 17 on the drill bit end the additional piston part 75 is separated from entraining shoulder 71 on tubular part 17 with the result that the effective hydraulic area for the derivation of axial forces on tubular part 17 on the drill bit end is reduced to a level that is defined by the outside diameter of cylinder wall area 35 of tubular part 17 on the drill bit end. Accordingly, the hydraulic axial force derived hydraulically on tubular part 17 on the drill bit end and thus as the drilling force on rotary drill bit 4 drops by stages from a maximum value in the position of the parts as illustrated in FIG. 9 to an average value in the position of the parts according to FIG. 10 with an increase in the extracted length of the telescoping assembly 14,15 and then finally drops to a minimum value as achieved in the position of the parts relative to each other as illustrated in FIG. 11. Stops on the cylinder wall area 35 and 76 that are not illustrated in detail here can limit the maximum extended length of a telescoping assembly 14,15.

In order to achieve an optimum in terms of flexural rigidity for a telescoping assembly 14,15 with an optimum of axial force that can be transmitted, the outside diameter of tubular part 16 on the casing end and the diameter that defines the largest effective hydraulic area for transmitting axial forces to tubular part 17 on the drill bit end are coordinated such that the square of the outside diameter of tubular part 16 divided by the square of the diameter of the effective hydraulic area yields a ratio that is within the range of 1.5 to 2.5.

As explained initially, in many cases a single telescoping assembly 14 or 15 provided with devices for creating an axial pressure within a drilling device is sufficient, but as shown in FIG. 1 two or more such devices 14,15 can be inserted directly or at intervals into the drilling equipment. In this case, the devices 14,15 may have the same or different design and the same or different construction, so there are different requirements regarding the variability of the hydraulic parameters that determine the hydraulic transfer of drilling force to rotary drill bit 4. With a sequential arrangement of telescoping assemblies 14,15 they may have a design by means of which they function one after the other by responding to different parameters.

What is claimed is:

1. A process for sinking a well in underground rock formations using a drilling tool suspended from a drill casing and having a drill bit disposed at the leading end thereof, said drilling tool including an axially telescoping assembly therein, comprising:

supplying said drilling tool with a flow of drilling mud through said drill casing during a drilling operation;

transferring an hydraulic force generated by said flow of drilling mud to said drill bit through said axially telescoping assembly; and varying the surface area within said drill tool on which said flow of drilling mud acts.

2. The process of claim 1, further comprising the step of varying the pressure of said drilling mud flow by varying the cross-sectional area within drilling tool through which said drilling mud flows.

3. The process of claim 1 or 2, wherein said variation is effected by changing the degree of extension of said telescopic assembly.

4. The process of claim 1 or 2, wherein the volume rate of said flow of drilling mud is used as a control parameter and wherein said transferred hydraulic force is determined as a function of the hook load of the drill casing.

5. A drilling apparatus for sinking a well in underground rock formations, adapted for suspension from a drill casing and having a rotary drill bit disposed at its leading end, including:

at least one telescopic assembly including an outer tubular part and an inner tubular part adapted for axial reciprocal movement within the outer tubular part, one of said parts being secured to said drill casing and the other having said drill bit disposed therefrom;

means for rotational coupling of said inner and outer tubular parts;

at least one pressure face on the part of said telescope assembly secured to said drill bit for transmitting an axial hydraulic force generated by a flow of drilling mud through said tool; and means for varying the internal hydraulic characteristics of said apparatus which generate said hydraulic force responsive to said flow of drilling mud.

6. The drilling apparatus of claim 5, wherein said telescopic assembly is positioned at the upper end of said drilling tool proximate said drill casing.

7. The drilling apparatus of claim 5, further including an outer casing, and wherein said telescopic assembly is disposed between an upper part and a lower part of said outer casing.

8. The drilling apparatus of claim 5, wherein said inner tubular part is on the drill bit end of said telescopic assembly, and includes a piston part having a piston face facing the flow of drilling mud.

9. The drilling apparatus of claim 8, wherein said piston part comprises a ring sealed on its circumference with respect to a cylinder wall area of said outer tubular part.

10. The drilling apparatus of claim 5, wherein said at least one telescopic assembly comprises a plurality of telescopic assemblies.

11. The drilling apparatus of claim 8, wherein said piston part comprises a differential piston.

12. A drilling apparatus for sinking a well in underground rock formations, adapted for suspension from a drill casing and having a rotary drill bit disposed at its leading end, including:

at least one telescopic assembly including an outer tubular part and an inner tubular part adapted for axial reciprocal movement within the outer tubular part, one of said parts being secured to said drill casing and the other having said drill bit disposed therefrom;

means for rotational coupling of said inner and outer tubular parts;

at least one pressure face on the part of said telescopic assembly secured to said drill bit for transmitting an axial hydraulic force generated by a flow of drilling mud through said tool; and means for varying the internal hydraulic characteristics of said apparatus which generate said hydraulic force responsive to said flow of drilling mud;

wherein said inner tubular part is on the drill bit end of said telescopic assembly, and includes a piston part having a piston face facing the flow of drilling mud;

wherein said piston part comprises a ring sealed on its circumference with respect to a cylinder wall area of said outer tubular part; and wherein said ring piston part comprises a separate component detachably secured to said inner tubular part, and said cylinder wall area is located on a component detachably secured to said outer tubular part.

13. A drilling apparatus for sinking a well in underground rock formations, adapted for suspension from a drill casing and having a rotary drill bit disposed at its leading end, including:

at least one telescopic assembly including an outer tubular part and an inner tubular part adapted for axial reciprocal movement within the outer tubular part, one of said parts being secured to said drill casing and the other having said drill bit disposed therefrom;

means for rotational coupling of said inner and outer tubular parts;

at least one pressure face on the part of said telescopic assembly secured to said drill bit for transmitting an axial hydraulic force generated by a flow of drilling mud through said tool; and means for varying the internal hydraulic characteristics of said apparatus which generate said hydraulic force responsive to said flow of drilling mud;

wherein said at least one pressure face comprises a plurality of axially separated pressure faces.

14. A drilling apparatus for sinking a well in underground rock formations, adapted for suspension from a drill casing and having a rotary drill bit disposed at its leading end, including:

at least one telescopic assembly including an outer tubular part and an inner tubular part adapted for axial reciprocal movement within the outer tubular part, one of said parts being secured to said drill casing and the other having said drill bit disposed therefrom;

means for rotational coupling of said inner and outer tubular parts;

at least one pressure face on the part of said telescopic assembly secured to said drill bit for transmitting an axial hydraulic force generated by a flow of drilling mud through said tool; and means for varying the internal hydraulic characteristics of said apparatus which generate said hydraulic force responsive to said flow of drilling mud;

wherein said means for varying the internal hydraulic characteristics of said apparatus are selectively actuable by varying the length of extension of said telescopic assembly.

15. A drilling apparatus for sinking a well in underground rock formations, adapted for suspension from a drill casing and having a rotary drill bit disposed at its leading end, including:

at least one telescopic assembly including an outer tubular part and an inner tubular part adapted for axial reciprocal movement within the outer tubular part, one of said parts being secured to said drill casing and the other having said drill bit disposed therefrom;

means for rotational coupling of said inner and outer tubular parts;

at least one pressure face on the part of said telescopic assembly secured to said drill bit for transmitting an axial hydraulic force generated by a flow of drilling mud through said tool; and means for varying the internal hydraulic characteristics of said apparatus which generate said hydraulic force responsive to said flow of drilling mud;

further including bypass channel means associated with said outer tubular part, said bypass channel means being progressively actuable for reducing pressure in said drilling mud flow by extraction of said inner tubular part from said outer tubular part.

16. A drilling apparatus for sinking a well in underground rock formations, adapted for suspension from a drill casing and having a rotary drill bit disposed at its leading end, including:

at least one telescopic assembly including an outer tubular part and an inner tubular part adapted for axial reciprocal movement within the outer tubular part, one of said parts being secured to said drill casing and the other having said drill bit disposed therefrom;

means for rotational coupling of said inner and outer tubular parts;

at least one pressure face on the part of said telescopic assembly secured to said drill bit for transmitting an axial hydraulic force generated by a flow of drilling mud through said tool; and means for varying the internal hydraulic characteristics of said apparatus which generate said hydraulic force responsive to said flow of drilling mud;

wherein the square of the outer diameter of the outer tubular part of the telescopic assembly divided by the square of the diameter of the largest pressure face yields a ratio value in the range of substantially 1.5 to 2.5.

17. A drilling apparatus for sinking a well in underground rock formations, adapted for suspension from a drill casing and having a rotary drill bit disposed at its leading end, including:

at least one telescopic assembly including an outer tubular part and an inner tubular part adapted for axial reciprocal movement within the outer tubular part, one of said parts being secured to said drill casing and the other having said drill bit disposed therefrom;

means for rotational coupling of said inner and outer tubular parts;

at least one pressure face on the part of said telescopic assembly secured to said drill bit for transmitting an axial hydraulic force generated by a flow of drilling mud through said tool; and means for varying the internal hydraulic characteristics of said apparatus which generate said hydraulic force responsive to said flow of drilling mud;

wherein said at least one telescopic assembly comprises a plurality of telescopic assemblies; and wherein at least one of said plurality of telescopic assemblies is adapted to become operable for varying said internal hydraulic characteristics before another of said plurality of telescopic assemblies.

18. A drilling apparatus for sinking a well in underground rock formations, adapted for suspension from a drill casing and having a rotary drill bit disposed at its leading end, including:

at least one telescopic assembly including an outer tubular part and an inner tubular part adapted for axial reciprocal movement within the outer tubular part, one of said parts being secured to said drill casing and the other having said drill bit disposed therefrom;

means for rotational coupling of said inner and outer tubular parts;

at least one pressure face on the part of said telescopic assembly secured to said drill bit for transmitting an axial hydraulic force generated by a flow of drilling mud through said tool; and means for varying the internal hydraulic characteristics of said apparatus which generate said hydraulic force responsive to said flow of drilling mud;

wherein said inner tubular part is on the drill bit end of said telescopic assembly, and includes a piston part having a piston face facing the flow of drilling mud;

wherein said piston part comprises a differential piston; and wherein said differential piston is disposed in sealing engagement between coaxial cylinder wall areas on said inner and outer tubular parts and is axially movable over a limited extent relative thereto.

19. The drilling apparatus of claim 18, wherein said cylinder wall area of said inner tubular part includes an entraining shoulder for contacting said piston part, and said cylinder wall area of said outer tubular part has a stop shoulder thereon for engaging said piston part, said stop shoulder being located axially below said entraining shoulder when said inner tubular part is fully inserted in said outer tubular part.

20. The drilling apparatus of claim 19, wherein the cylinder wall area of the inner tubular part includes a stop axially spaced above said entraining shoulder.

21. A drilling apparatus for sinking a well in underground rock formations, adapted for suspension from a drill casing and having a rotary drill bit disposed at its leading end, including:

at least one telescopic assembly including an outer tubular part and an inner tubular part adapted for axial reciprocal movement within the outer tubular part, one of said parts being secured to said drill casing and the other having said drill bit disposed therefrom;

means for rotational coupling of said inner and outer tubular parts;

at least one pressure face on the part of said telescopic assembly secured to said drill bit for transmitting an axial hydraulic force generated by a flow of drilling mud through said tool; and means for varying the internal hydraulic characteristics of said apparatus which generate said hydraulic force responsive to said flow of drilling mud;

wherein said inner tubular part is on the drill bit end of said telescopic assembly, and includes a piston part having a piston face facing the flow of drilling mud; and wherein said piston part comprises a differential piston;

further including a bushing slidable on the cylinder wall area of said inner tubular part, sealed at its lower end with respect thereto, and providing a cylinder wall area on its exterior for said differential piston.

22. The drilling apparatus of claim 21, further including a stop shoulder on said outer tubular part for limiting the downward travel of said bushing.

23. A drilling apparatus for sinking a well in underground rock formations, adapted for suspension from a drill casing and having a rotary drill bit disposed at its leading end, including:

at least one telescopic assembly including an outer tubular part and an inner tubular part adapted for axial reciprocal movement within the outer tubular part, one of said parts being secured to said drill casing and the other having said drill bit disposed therefrom;

means for rotational coupling of said inner and outer tubular parts;

at least one pressure face on the part of said telescopic assembly secured to said drill bit for transmitting an axial hydraulic force generated by a flow of drilling mud through said tool; and means for varying the internal hydraulic characteristics of said apparatus which generate said hydraulic force responsive to said flow of drilling mud;

wherein said inner tubular part is on the drill bit end of said telescopic assembly, and includes a piston part having a piston face facing the flow of drilling mud; and wherein said piston part comprises a ring sealed on its circumference with respect to a cylinder wall area of said outer tubular part;

further including a tubular nozzle body on said outer tubular part for engaging said inner tubular part, said nozzle body defining an annular gap with said ring piston part for receiving said flow of drilling mud through said apparatus, said annular gap being variable in cross-sectional area with extension of said telescopic assembly and extraction of said inner tubular part from said outer tubular part.

24. The drilling apparatus of claim 23, wherein said tubular nozzle body is supported in said outer tubular part by a bushing including axial boreholes therethrough.

25. The drilling apparatus of claim 23, wherein said tubular nozzle body is selectively replaceable with another of same having different hydraulic characteristics.

* * * * *